US011464095B2

(12) United States Patent
Sherriff

(10) Patent No.: US 11,464,095 B2
(45) Date of Patent: Oct. 4, 2022

(54) CLONED CONSTANT CURRENT LED DRIVE CIRCUIT AND METHOD FOR USE

(71) Applicant: Methode Electronics, Inc., Chicago, IL (US)

(72) Inventor: Eric D. Sherriff, Nelson (CA)

(73) Assignee: Methode Electronics, Inc., Chicago, IL (US)

( * ) Notice: Subject to any disclaimer, the term of this patent is extended or adjusted under 35 U.S.C. 154(b) by 0 days.

(21) Appl. No.: 17/387,283

(22) Filed: Jul. 28, 2021

(65) Prior Publication Data

US 2022/0117060 A1 Apr. 14, 2022

Related U.S. Application Data

(60) Provisional application No. 63/091,511, filed on Oct. 14, 2020.

(51) Int. Cl.
*H05B 45/34* (2020.01)
*H05B 45/46* (2020.01)
*H05B 45/345* (2020.01)

(52) U.S. Cl.
CPC ..... *H05B 45/46* (2020.01); *H05B 45/345* (2020.01)

(58) Field of Classification Search
CPC ..... H05B 45/20; H05B 45/34; H05B 45/345; H05B 45/46; H05B 47/10
See application file for complete search history.

(56) References Cited

U.S. PATENT DOCUMENTS 7,952,295 B2 * 5/2011 Otake ..... H05B 45/46 315/294
8,358,080 B2 * 1/2013 Nakamura ..... H05B 39/04 315/307

* cited by examiner

*Primary Examiner* — Jimmy T Vu
(74) *Attorney, Agent, or Firm* — Blank Rome LLP

(57) ABSTRACT

A light emitting diode (LED) circuit is disclosed having a plurality of LEDs each having a respective current path. A controller may be included for controlling the LEDs. A first set of LEDs of the plurality of LEDs are connected to respective first set transistors and a first current sink to drive a constant current through each of the first set of LEDs and the first set of LEDs includes one or more LEDs, and the LED circuit may include at least one second set of LEDs of the plurality of LEDs that are connected such that the constant current in the first set of LEDs is duplicated. in the at least one second set of LEDs and the second set of LEDs includes one or more LEDs.

18 Claims, 2 Drawing Sheets

CLONED CONSTANT CURRENT LED DRIVE CIRCUIT AND METHOD FOR USE

CROSS-REFERENCE TO RELATED APPLICATION

This application claims priority under 35 U.S.C. § 119(e) to U.S. Provisional patent application No. 63/091,511, filed Oct. 14, 2020, which is hereby incorporated by reference in its entirety.

BACKGROUND OF THE INVENTION

Light emitting diodes (LEDs) used in automotive and other applications often need to be driven with a constant current to meet optical and/or electrical design specifications and other requirements. In particular, in automotive applications, a constant current state can control light output from LEDs over a range of ambient and operating temperatures expected during vehicle operations. Moreover, a constant current can control light output from LEDs in the case of varying supply voltages that, depending on battery design and state of health, may deviate from nominal 12 volts by a significant amount.

Existing LEDs products for automotive and other application may not use constant current at all, in which case their performance is inferior. Others use multiple integrated circuit to drive multiple LEDs, or special integrated circuits capable of driving multiple LEDs, which increase the product's cost.

What is needed, therefore, is a low-cost electronic circuit design that can drive multiple LEDs with constant current having an integrated circuit controller (or other device, circuit, or component arrange) that provides constant current to drive one LED (or a few LEDs) and that allows for the current in the one (or few) LEDs to be copied (cloned) for other LEDs.

SUMMARY OF THE INVENTION

Disclosed herein are example red, green, and blue (RGB) light emitting diodes (LED) in a module for use in automotive and other applications. Also disclosed is an exemplary circuit in which a particular current path driving the RGB LEDs is cloned for respective additional RGB LEDs. The LED circuits may include, for example, a plurality of LEDs each having a respective current path. A controller and related software may be used for controlling the plurality of LEDs.

Also disclosed herein are methods of controlling the RGB module by interfacing the same with an electronics system of an automobile or other system in which the module is integrated.

In one aspect, the module includes a plurality of LEDs each having a respective current path, and each of the of LEDs is adapted for outputting a user-selectable white or non-white light. An electrical connection is used for connecting the module to an external electrical system for power and, optionally, control. A software stored in a storage media device may be used for controlling electrical signals to the plurality of LEDs. A first set of LEDs of the plurality of LEDs may be red, blue, and green (RBG) LEDs and are connected to respective transistors and a current sink to drive a constant current through each of the RGB LEDs. At least one second set of LEDs of the plurality of LEDs are also RGB LEDs and are connected such that the constant current in the first set of LEDs is duplicated (cloned) in the at least one second set of RGB LEDs.

In another aspect, the LED circuit includes a plurality of LEDs each having a respective current path, and each is adapted for outputting a user-selectable white or non-white light. A controller is used to control the plurality of LEDs. The controller may include a software stored in a storage media device. A current sink may he used for driving a constant current through the plurality of LEDs, as described above.

In still another aspect, the circuit design employs only low-cost commodity components to provide additional LED drives, such as low cost transistor and resistor sets.

In another aspect, the circuit can be adapted to integrated circuits that source current by inverting the topology and changing the polarity of the transistors to NPN.

In still another aspect, the scaling granularity of the circuit from one set to multiple sets of LEDs is considered "perfect" in that there may be one additional resistor and transistor needed for each additional LED, so there is no penalty or advantage to any particular number of LEDs that are cloned.

In addition, multiple cloned LED drives could he combined to drive a higher current through one higher power LED instead of multiple LEDs.

In another aspect, the modules and circuits as shown and described may be used to drive multiple LEDs with constant current in any product, including those found in transportation systems (e.g., automotive, rail, and aerospace), industrial systems, consumer products (e.g., entertainment devices and household appliances), and medical devices that output or require illumination.

DETAILED DESCRIPTION OF THE INVENTION

Figure 1:
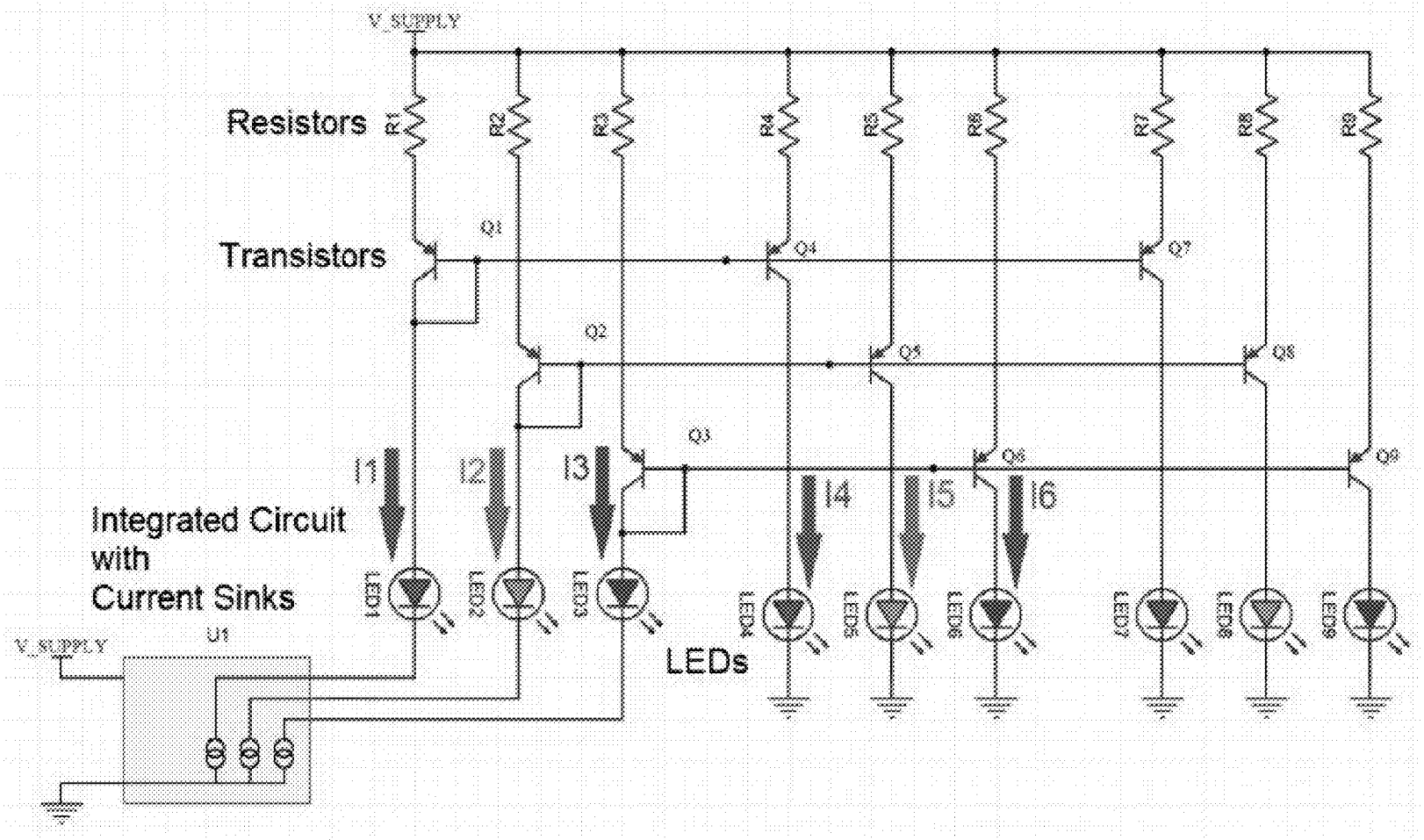
FIG. 1 is a schematic drawing of an RGB LED integrated circuit showing a primary RGB LED constant current circuit and two cloned RGB LED circuits.

With reference to FIG. 1, shown therein is an integrated circuit LED driver (U1) that has at least three current sinking pins or connections (i.e. current is regulated as it is returned, or sinks, to ground), resistors R1 through R9, corresponding transistors Q1 through Q9, and corresponding LEDs identified as LED1 through LED9. While, U1 is shown having at least three current sinking pins to correlate with the three LED channels of an RGB LED, this description is equally applicable to the cloning of current from one or more LEDs or LED channels. Similarly, all of the LED channels connected to U1 need not be cloned (as discussed below). However, for the purposes of this disclosed example, all three of the available LED channels for RGB will each be cloned. In addition, the current sink need not be an integrated circuit, but could also be one or more discrete design current sinks, but the discussion below will utilize the example integrated circuit current sink for example purposes.

LED driver U1 is suitable for driving an RGB arrangement of LEDs. It accurately sets the current through LED1, LED2, and LED3. The current-setting mechanism may be resistors external to the integrated circuit LED driver, or the current sinks may be software controlled by a processor included in the integrated circuit LED driver.

LED driver U1 may have three sinking pins or connections for controlling the three different LED channels of a single RGB LED or separate red, green, and blue LEDs. It should be understood, however, that other controllers having greater or fewer pins could also be used so long as the LED drive U1 contains at least the number pins corresponding to the number of LEDs or LED channels to be controlled directly by U1. Further, as will be described below, the ultimate number of controlled LEDs will not be limited by number of pins or LED channels, because each of the LED channels directly controlled by U1 can be cloned to control additional LEDs.

The sinking pin of the LED driver U1 can be utilized to sink a constant current through resistors R1, R2, and R3 into, for example, U1 pin 1, U1 pin 2, and U1 pin 3 (not shown), respectively. Because of the constant current sinking capability of even a low cost U1 controller, a precise constant voltage across resistors R1, R2, and R3 is developed, which optionally can be varied using the PWM duty cycle capabilities of LED driver U1 to compensate for circuit variance.

Because of the series circuit arrangement as shown, the integrated circuit LED driver's current sinks can set the current passing through resistors R1, R2, and R3, but also as well as the PNP sensing transistors Q1, Q2, and Q3.

The sensing transistors Q1, Q2, and Q3 have their collector and base terminals connected as shown, so the net collector-emitter voltages are equal to the base-emitter junction voltages for those transistors with that specific current (i.e., the LED drive current set by the controller, I1, I2, and I3).

The resistor and base-emitter voltage drops across the resistors R1, R2, and R3, and the transistors Q1, Q2, and Q3, respectively, are connected to additional driver transistors and resistors associated with additional, e.g., cloned, RGB LEDs. For example, the resistors R4, R5, and R6, and the transistors Q4, Q5, and Q6, can set the LED drive current in I4, I5, and I6, respectively. For example, the base-emitter voltage drop of Q1 is "reversed" through the transistor Q4 base-emitter to the resistor R4. The same is true with respect to the other LED channels. Provided the transistors and resistors of the cloned channels have similar values as the original channel (i.e. those directly connected to U1 (Q1, Q2, Q3)), then the voltage drops across R4, R5, R6, will be respectively similar to that of R1, R2, R3 and ultimately the currents I4, I5, I6 will be cloned to I1, I2, I3, respectively. Similarly, the resistors R7, R8, and R9, and the transistors Q7, Q8, and Q9, can set the LED drive current in I7, I8, and I9. This "impressing" of the specific voltage caused by the set current flowing through the resistor and transistor across additional transistors of the same type and resistors of the same value results in the current set by the integrated circuit being copied (cloned) in those additional transistor circuits. That is, I4 is a clone of I1, I5 is a clone of I2, and I6 is a clone of I3. This arrangement also has the effect of canceling the temperature, and other environmental effects, on the base-emitter voltage of the respective transistors. For example, regardless of the change in base-emitter voltage of, for example, Q1, the effect will be reversed/compensated for by Q4 in establishing the voltage drop of R4.

It should be noted that in practice the resistors associated with sensing transistors, i.e. those of the cloned channels, are slightly higher in value than those associated with driving (or direct) transistors (Q1, Q2, Q3). This is to compensate for the loss of the base current in the driving transistors. By way of example, for a 27 mA design, the difference in resistor values is just one step on the Electronic Industries Association (EIA) E96 resistor value table (137 Ohms for the sense transistor resistor vs 133 Ohms for the driver transistor resistor).

As described above, the circuit design of FIG. 1 is compatible with PWM.

Due to series topology, the cloned currents are used to drive additional LEDs above and beyond the controller's pin capacity. By copying the base emitter voltage for a specific current and impressing that onto a transistor of the same type, it compensates for temperature induced changes in VBE (voltage drop between the base and the emitter). Voltage developed across the emitter resistors in the driving transistor circuits serves to mask VBE voltage variance seen between individual transistors of the same type.

Figure 2:
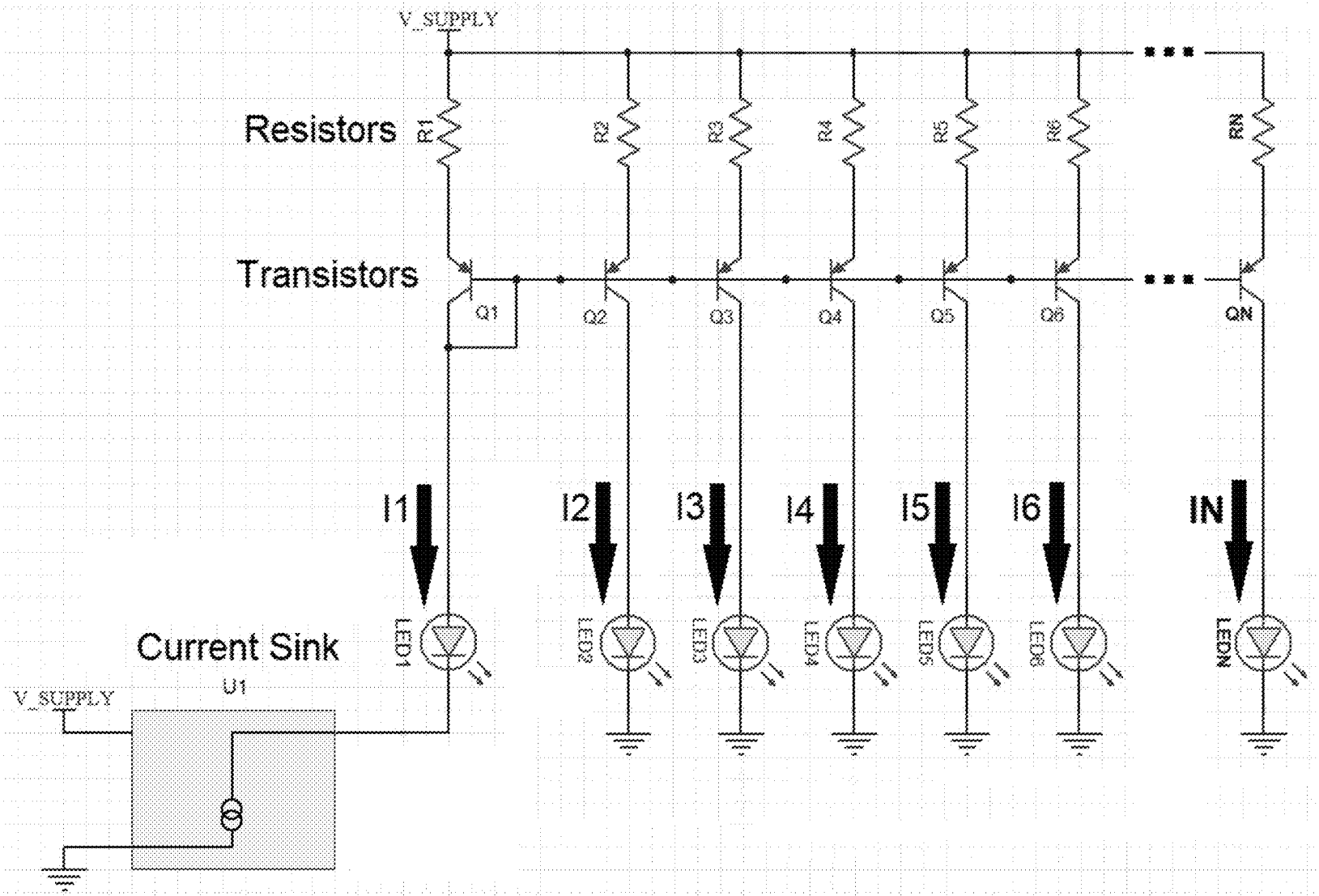
FIG. 2 is a schematic drawing of an LED integrated circuit showing a primary LED constant current circuit and N number of cloned LED circuits.

FIG. 2 is similar to FIG. 1, but instead of using an RGB LED, or discrete red, green, and blue LEDs, only a single primary, or directly driven LED using current I1, is shown and between one (LED2) and N (LEDN) secondary LEDs having current I2 through IN, respectively, is shown. While six secondary LEDs are shown with cloned current (I2, I3, I4, I5, I6, IN), FIG. 2 shows that the number of secondary LEDs may be expanded until N number of LEDs as symbolized by the ellipsis.

In use, electrical signals, including sensed current, in the above-described circuit may be managed by, for example, embedded software stored in an appropriate memory device on the same printed circuit board as the circuit or on one or more separate but electrically-coupled. circuit boards. The present circuit may be interfaced with external circuits of, for example, an automotive vehicle electrical system, using one or more suitable electrical connectors, including industry standard pin and socket connectors. The embedded software may include one or more suitable algorithms that may receive signals from the external circuits that represent inputs from a user, such as a vehicle operator, that are intended to alter one or more conditions of the LEDs (for instance, increasing brightness, changing color mix, etc.). The memory device may include specific settings, as input to the software, that establish a state of the circuit and its LEDs when the device in which the circuit is installed is first turned on, turned off, or is in a particular operating condition (e.g., a vehicle operating during nighttime conditions).

While particular elements, embodiments and applications of the present invention have been shown and described, it will be understood, that the invention is not limited thereto since modifications can be made by those skilled in the art without departing from the scope of the present disclosure, particularly in light of the foregoing teachings.

What is claimed is:

1. A light emitting diode (LED) lighting module comprising:

a plurality of LEDs each having a respective current path, each of the plurality of LEDs adapted for outputting a user-selectable white or non-white light;

an electrical connection for connecting the module to an external electrical system; and optionally a software stored in a storage media device for controlling electrical signals to the plurality of LEDs, wherein a first set of LEDs of the plurality of LEDs are connected to respective transistors and a current sink to drive a constant current through each of the first set of LEDs and the first set of LEDs includes one or more LEDs, and wherein at least one second set of LEDs of the plurality of LEDs are connected such that the constant current in the first set of LEDs is duplicated in the at least one second set of LEDs and the second set of LEDs includes one or more LEDs.

2. A light emitting diode (LED) circuit comprising:

a plurality of LEDs each having a respective current path, each of the plurality of LEDs adapted for outputting at least one of a white or non-white light and;

a controller for controlling the plurality of LEDs wherein a first set of LEDs of the plurality of LEDs are connected to respective first set transistors and a first current sink to drive a constant current through each of the first set of LEDs and the first set of LEs includes one or more LEDs, and wherein at least one second set of LEDs of the plurality of LEDs are connected such that the constant current in the first set of LEDs is duplicated in the at least one second set of LEDs and the second set of LEDs includes one or more LEDs.

3. The LED circuit of claim 2, wherein the controller comprises a software stored in a storage media device.

4. The LED circuit of claim 2, wherein the second set of LEDs are connected to a second current sink different than the first current sink.

5. The LED circuit of claim 2, wherein each of the first set transistors comprise a first set transistor base and a first set transistor collector and each of the respective first set transistor bases and first set transistor collectors are respectively electrically connected to each other.

6. The LED circuit of claim 5, wherein each of the second set of LEDs are connected to respective second set transistors, each second set transistors comprising a second set transistor base and a second set transistor collector, wherein at least one first set transistor base is electrically connected to at least one second set transistor base.

7. The LED circuit of claim 5, wherein the first current sink is an integrated circuit LED driver.

8. The LED Circuit of claim 7, wherein the current in the second set of LEDs is a second set LED current and the constant current through each of the first set of LEDs together with the second set LED current is greater than the current sink of the first current sink.

9. The LED circuit of claim 7, wherein the integrated circuit LED driver has a plurality of current sinking pins.

10. The LED circuit of claim 8, wherein the integrated circuit LED driver has three current sinking pins and the first set of LEDs comprises a red LED, a green LED, and a blue LED, and the second set of LEDs includes at least one second set red LED, at least one second set green LED, and at least one second set blue LED.

11. The LED Circuit of claim 8, wherein the first set of LEDs and the second LED, together, outnumber the current sinking pins.

12. The LED circuit of claim 6, wherein each of the first set transistor bases are electrically connected, respectively, to each of the second set transistor bases.

13. The LED circuit of claim 6, wherein each of the second set transistors comprise a second set transistor emitter and the second set transistor emitter is electrically connected to a voltage supply through a sense transistor resistor.

14. The LED circuit of claim 13, wherein each of the first set transistors comprise a first set transistor emitter and the first set transistor emitter is electrically connected to the voltage supply through a respective, driver transistor resistor.

15. The LED circuit of claim 14, wherein the driver transistor resistor has a driver transistor resistance, the sense transistor resistor has a sense transistor resistance, and the driver transistor resistance is about the same as the sense transistor resistance.

16. The LED circuit of claim 15, wherein the driver transistor resistor has a driver transistor resistor voltage drop and the sense transistor resistor has a sense transistor resistor voltage drop and the driver transistor resistor voltage drop and the sense transistor resistor voltage drop are about equal.

17. The LED circuit of claim 14, wherein the driver transistor resistor has a driver transistor resistance, the sense transistor resistor has a sense transistor resistance, and the sense transistor resistance is higher than the driver transistor resistance.

18. The LED circuit of claim 17, wherein the sense transistor resistance is higher than the driver transistor resistance by about one step on the EIA E96 resistor value table.

* * * * *